US008193459B2

(12) United States Patent
Abroy

(10) Patent No.: US 8,193,459 B2
(45) Date of Patent: Jun. 5, 2012

(54) LUG-JAW FOR ELECTRICAL JOINT

(75) Inventor: Hamid S. Abroy, Lexington, KY (US)

(73) Assignee: Schneider Electric USA, Inc., Palatine, IL (US)

( * ) Notice: Subject to any disclaimer, the term of this patent is extended or adjusted under 35 U.S.C. 154(b) by 446 days.

(21) Appl. No.: 12/437,923

(22) Filed: May 8, 2009

(65) Prior Publication Data

US 2010/0282578 A1 Nov. 11, 2010

(51) Int. Cl.
*H01H 9/00* (2006.01)

(52) U.S. Cl. ..... 200/17 R; 200/51.11; 337/194

(58) Field of Classification Search ..... 200/17 R, 200/51.11; 337/194, 210
See application file for complete search history.

(56) References Cited

U.S. PATENT DOCUMENTS 3,775,723 A * 11/1973 Mamrick et al. ..... 337/245
4,851,963 A * 7/1989 Miller et al. ..... 361/643
RE34,113 E * 10/1992 Miller et al. ..... 361/643
5,270,500 A * 12/1993 Guiney ..... 200/17 R
5,406,449 A * 4/1995 Hicks et al. ..... 361/616
6,630,637 B1 * 10/2003 Ward et al. ..... 200/17 R
6,853,289 B2 * 2/2005 Scoggin ..... 337/194

OTHER PUBLICATIONS

Photographs of Prior Art Pull-Out Handle Assembly and Base Assembly Available from Square D.; (printed Mar. 11, 2009); (1 page).
Photographs of Terminals Available from Square D, Milbank, Midwest, and Cutler-Hammer; (printed Mar. 11, 2009); (1 page).
Photographs of Connectors and Pull-Out Assemblies Available from Square D, Milbank, Midwest, and Cutler-Hammer; (printed Mar. 11, 2009); (1 page).

* cited by examiner

*Primary Examiner* — Xuong Chung Trans

(57) ABSTRACT

A disconnect assembly for making and breaking electrical connections to an electrical circuit. The disconnect assembly includes a pullout assembly and a base assembly. The pullout assembly has downwardly facing extensions with slits in them to receive a blade that is inserted securely through the slits. The exposed portions of the blade are received in corresponding lug-jaw connectors in the base assembly. The lug-jaw connectors have a lug and a half jaw attached to the lug. The half jaw has a curved clip portion that opposes a side surface of the lug such that the exposed portion of the blade is received between the clip portion and the side surface, thereby resulting in minimal use of conductive material for the disconnect assembly.

16 Claims, 3 Drawing Sheets

LUG-JAW FOR ELECTRICAL JOINT

FIELD OF THE INVENTION

This invention relates generally to disconnect assemblies for electrical joints.

BACKGROUND

In known air conditioning disconnect (ACDC) systems, a disconnect assembly has a pullout assembly with conductive jaws separable from "conductive connectors" affixed in a base assembly to conductive lugs. The conductive connectors are bent at a 90 degree angle to receive the respective conductive jaws. The pull out assembly includes a full jaw connected to a handle. The base assembly includes a lug that is secured to a base of the base assembly and a corresponding conductive connector. In the conductive position the conductive connectors of the base assembly are mated to a pair of the full jaws of the pullout assembly, allowing current to flow from one lug, which receives line current, across the pair of full jaws, to another lug, which provides the line current to the air conditioning load. The full jaw includes two pieces of copper that are bent to form a jaw-like arrangement. Copper is expensive. In addition, in existing designs, numerous parts are required to form the disconnect assembly. The lug is spaced away from the 90 degree connectors that receive the jaws of the pullout assembly. Rivets or screws are required to fasten the two jaw halves together, and for every jaw, a corresponding 90 degree connector is required. In short, prior-art systems use too many parts and are expensive because they overuse the amount of copper that is needed. They also present a number of joints, and joints are undesirable because they produce heat due to electrical current crowding at the transitions and reduce the delivery efficiency of the current.

What is needed, therefore, among other things, is a disconnect assembly that requires as few parts as possible while reducing the overall amount of copper used compared to existing designs. The present disclosure fulfills these and other needs.

BRIEF SUMMARY OF THE PRESENT INVENTION

According to some embodiments of the present invention, in an electrical circuit where an electrical connection needs to be made or broken, a disconnect assembly is placed in the circuit that allows an operator or a device to disconnect the load from the electrical circuit. The disconnect assembly includes a pullout assembly that has metal blades, which provide the electrical path for current between a line and a load connection, that are inserted into blade-receiving extensions and held in place there as the pullout assembly is inserted into or removed from a base assembly to make or break electrical connections. The base assembly includes a lug-jaw connector that is composed of a lug and an adjacent half jaw. The half jaw uses less copper compared to previous designs, which have used a full jaw to make the electrical connection. The half jaw can be secured to the lug through friction or an attachment means such as a screw. The half jaw may resemble a clip such that when the conductive blade is inserted between, and in contact with, the half jaw and the lug, the blade is held securely in place so that current can flow from the line to the load side of the circuit. To break the electrical connection, the pullout assembly is removed manually or automatically so that the conductive blade thereof physically detaches from the lug-jaw connectors. When the disconnect device is removed an open circuit is created between the line and load portions of the circuit and no current can flow. Compared to previous designs, the disconnect assembly of the present invention advantageously uses far fewer parts, less of the expensive copper conductor, and presents fewer sharp transitions at the joints to electrical current, among other benefits.

The foregoing and additional aspects of the present invention will be apparent to those of ordinary skill in the art in view of the detailed description of various embodiments, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1:
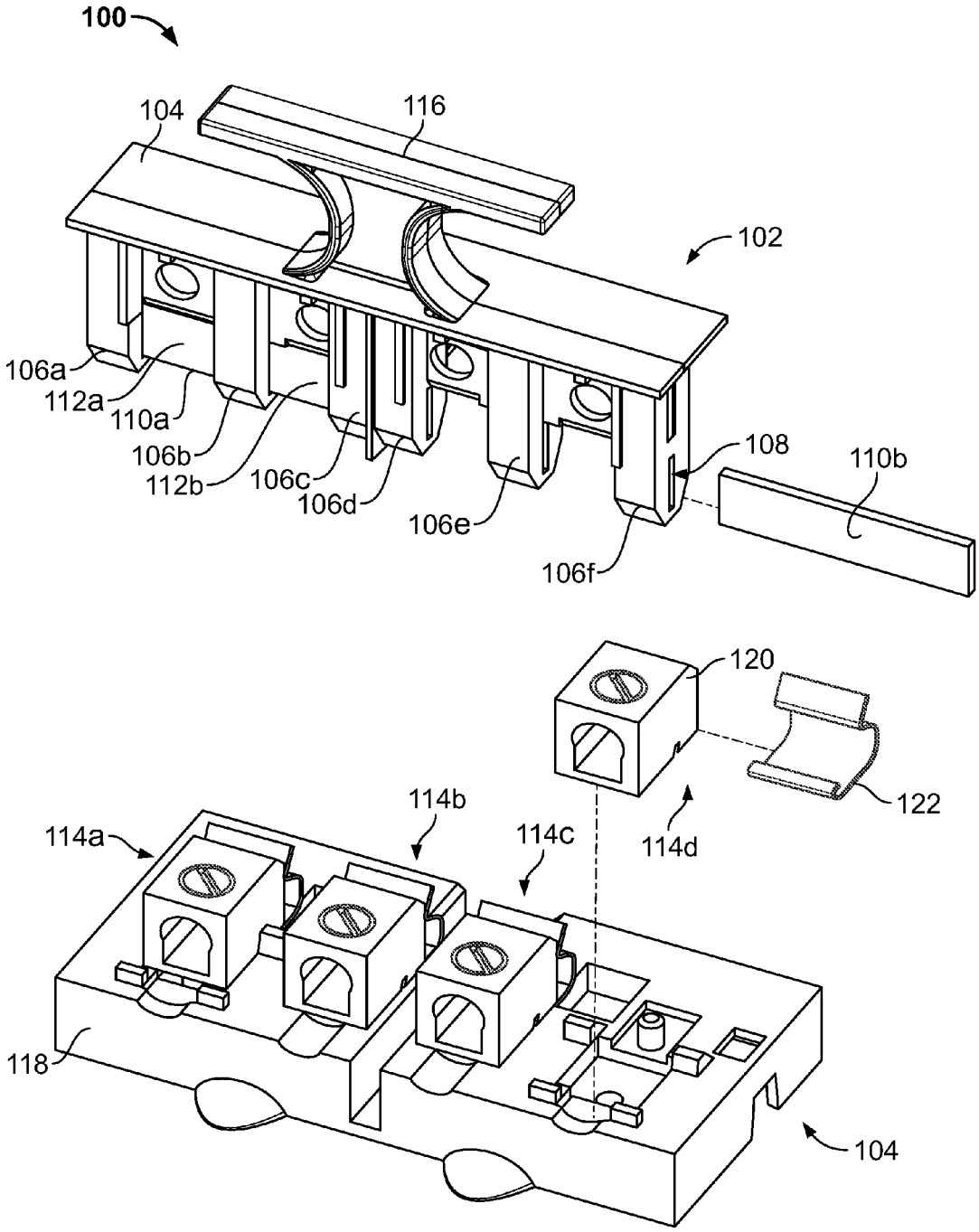
FIG. 1 is a partially exploded, isometric view of a disconnect assembly that includes a pullout assembly and a base assembly.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 is a partially exploded, isometric view of a disconnect assembly 100 according to an aspect of the present disclosure, for making and breaking an electrical connection to an electrical circuit (not shown) to which the assembly 100 is connected. The assembly 100 includes a pullout assembly 102 and a base assembly 104. The pullout assembly 102 is composed of a non-electrically conductive material, such as plastic, and includes blade-receiving extensions 106*a-f* that extend away from the face portion 104 as shown. Each of the blade-receiving extensions 106*a-f* includes a corresponding channel 108 (only one channel is numbered for clarity). The assembly 100 further includes a pair of flat blades 110*a*, 110*b* that are slidably received within corresponding channels 108 of the blade-receiving extensions 106. One of the blades 110*b* is shown removed from the channels 108 of the blade-receiving extensions 106*d-f* in FIG. 1 to illustrate how it is slid into the pullout assembly 100 via the channels 108.

The flat blade 110*a* includes two exposed portions 112*a,b* for connection to respective lug-jaw connectors 114*a,b,c,d*, as explained below. The flat blade 110 preferably has a rectangular shape and can be tapered at its ends to permit the flat blades 110*a,b* to be easily inserted into the respective channels 108. While described as "flat," the conductive blades 110*a,b* might also be formed in contoured shapes and individually fitted between each pair of blade-receiving extensions 106*a-f* although such an embodiment would likely increase part count and assembly steps. It should be emphasized that the blades 110 fit snugly into the channels 108 without any additional attachment means, such as screws, rivets, or other fasteners, to hold them therein. Although three blade-receiving extensions 106 are shown to receive one blade, only a minimum of one blade-receiving extension may be required to receive the blade through a channel of the blade-receiving extension.

The pullout assembly 102 preferably includes a pullout handle 116 connected to the face portion 104. The pullout handle 116 can be molded and composed of a plastic-based dielectric material. In applications such as an air conditioning disconnect (ACDC) in which the electric circuit includes an air conditioning load or in which the electric circuit is incorporated into a load center, the handle 116 is grasped by the operator and pulled away from the base assembly 104 to cause the blades 110*a,b* to separate from the respective lug-jaw connectors 114. In the illustrated example of FIG. 1, a single-pole or single-phase assembly is shown having two line-load connections. Connections to a load of the electrical circuit, such as an air conditioning unit (not shown), are made via respective lug-jaw connectors 114*a,d*. Connections to line power are made via respective lug-jaw connectors 114*b,c*. In applications in which only one line-load connection is needed, two of the lug-jaw connectors 114 can be eliminated as well as one of the blades 110.

In applications in which the assembly 100 is incorporated into a circuit breaker or a switch, the handle 116 is not needed, and a conventional mechanism is coupled to the pullout assembly 102 to disconnect the pullout assembly 102 from the electrical circuit. The mechanism conventionally urges the flat blade out of the lug-jaw connectors 114. It should be emphasized that the assembly 100 of the present disclosure can be incorporated into any electrical circuit that requires the making and breaking of an electrical connection anywhere in the circuit. This assembly 100 is interposed into the circuit at the point where an electrical disconnect is needed.

The base assembly 104 includes the lug-jaw connectors 114*a-d*, which are conventionally attached to a base 118 of the base assembly 104. One of the lug-jaw connectors 114*d* is shown exploded away from the base 118 in FIG. 1. Also referring to FIG. 2, the lug-jaw connector 114*d* includes a lug 120 and a half jaw 122 securely coupled to the lug such as in one of the manners described below. The half jaw 122 includes a curved clip portion 124 adjacent a side surface 126 of the lug 120. A bottom 128 of the lug 120 is mounted to the base 118 according to conventional techniques.

Figure 2:
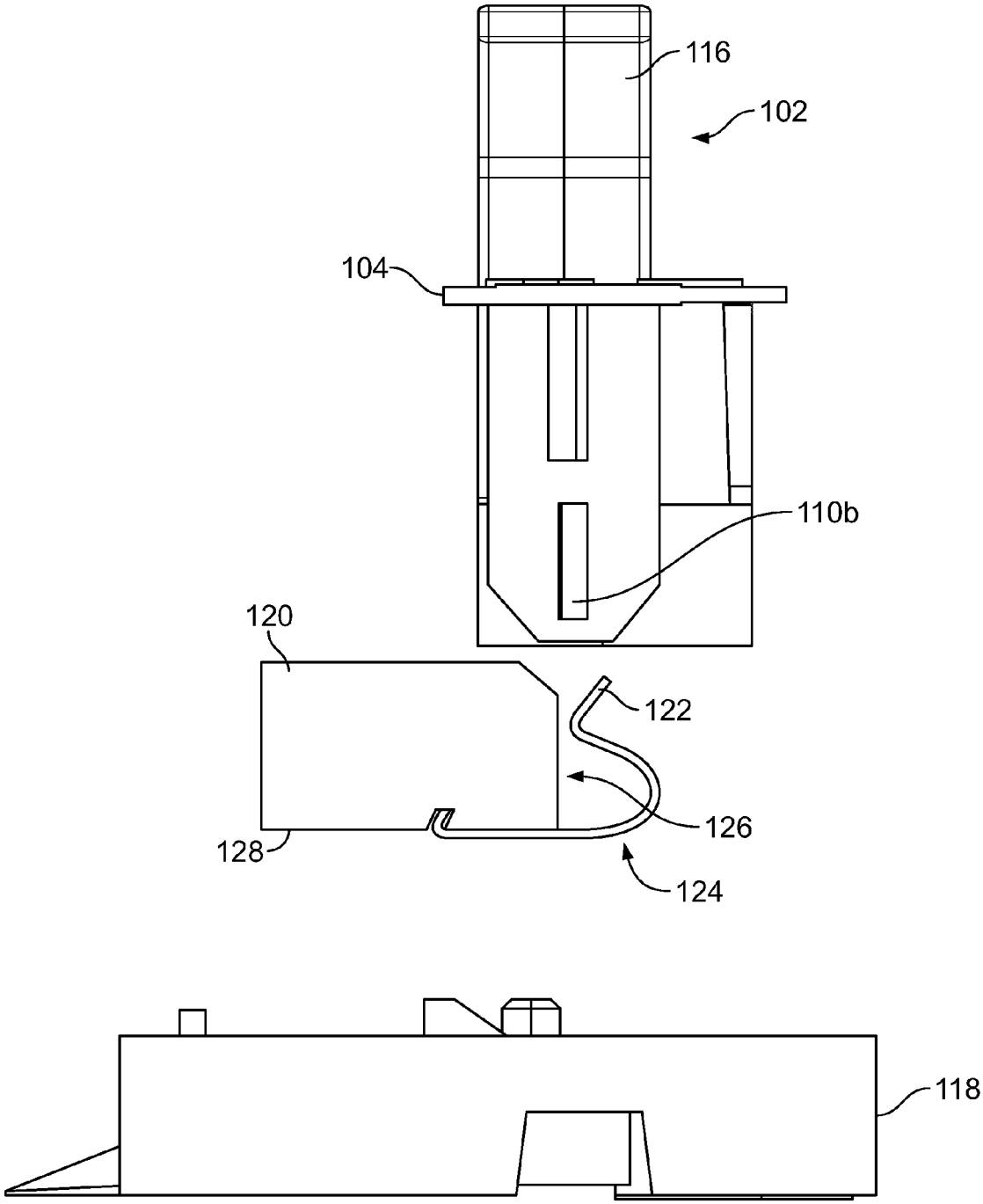
FIG. 2 is a side view of the disconnect assembly shown in FIG. 1.
Figure 3A:
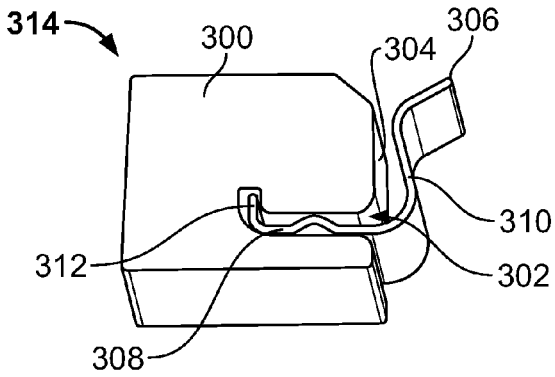
FIG. 3A is a side view of a lug-jaw connector in which a half jaw is securely received within a pocket of the lug.

FIGS. 1 and 2 illustrate a particular configuration of the lug-jaw connector 114 that can be mounted to the base 118 of the base assembly 104. In other aspects, the lug-jaw connector can have different configurations, such as illustrated in FIGS. 3A-4B. In FIG. 3A, a lug-jaw connector 314 includes a lug 300 that has a pocket 302 opening into the side surface 304 of the lug 300. A half jaw 306 includes a retaining portion 308 that transitions into a clip portion 310. It is important to note that in this configuration, no screws or other attachment means are required to secure the half jaw 306 to the lug 300. The retaining portion 308 of the half jaw 306 is bent so that frictional forces hold the retaining portion 308 securely in place within the pocket 302. An end 312 of the lug 300 is bent upwards as shown in FIG. 3A to prevent the half jaw 306 from being pulled out of the pocket 302 when a blade is inserted into or removed from the lug-jaw connector 314. An end view of this configuration can be seen in FIG. 4A with the blade 110*b* inserted between the clip portion 310 of the half jaw 306 and the side surface 304 of the lug 300. The blade 110*b* contacts surfaces of both the clip portion 310 and the side surface 304. This configuration reduces the number of joints that electrical current flowing across the blade 110*b* experiences. By having the blade 110 contact the side surface 304 of the lug 300, it is possible to use only half of a full jaw according to the present invention. The side surface 304 of the lug 300 provides one of the two surfaces needed to hold the blade 110 securely in place to couple current between the line to the load of the electrical circuit.

Figure 3B:
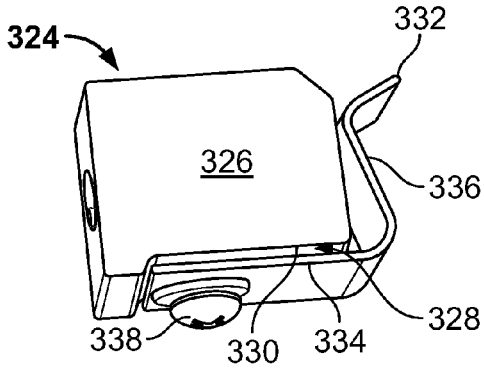
FIG. 3B is a side view of a different lug-jaw connector in which a half jaw is screwed to a bottom groove of the lug.
Figure 4A:
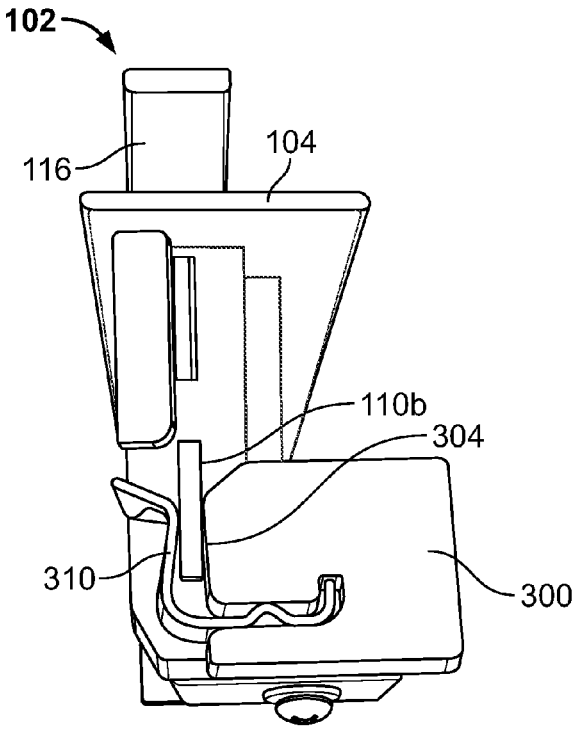
FIG. 4A is a side view of the lug-jaw connector of FIG. 3A connected to a pullout assembly.
Figure 4B:
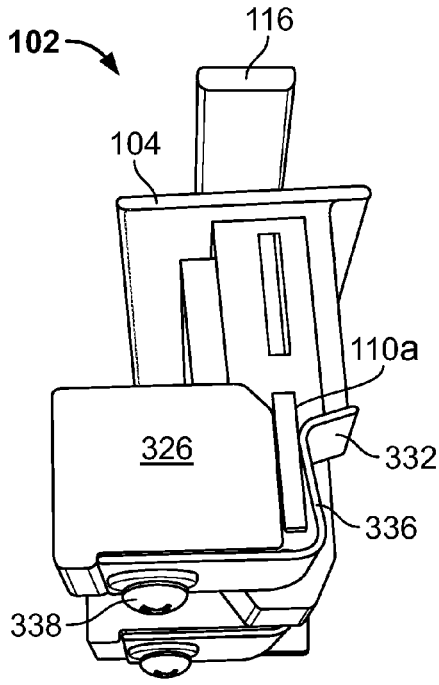
FIG. 4B is a side view of the lug-jaw connector of FIG. 3B connected to a pullout assembly.

FIG. 3B illustrates another configuration of a lug-jaw connector 324. In this configuration, the lug-jaw connector 324 includes a lug 326 that has a groove 328 on a bottom surface 330 of the lug 326. A half jaw 332 includes a retaining portion 334 that transitions into a clip portion 336. The retaining portion 334 is secured to the bottom surface 330 of the lug 326 by an attachment means 338, such as a screw, fastener, or rivet. The clip portion 336 is bent away from the lug 326 as shown in FIG. 3B to allow the blade 110*a,b* to be readily received between the clip portion 336 and the lug 326. The blade 110*a* contacts both the lug 326 and the clip portion 336 of the half jaw 332, as shown in FIG. 4B.

Any of the blades, lugs, and half jaws described herein can be composed of a conductive material, including aluminum, copper, or alloys thereof. Specifically, any of the half jaws described herein can be composed of a material that includes copper, such as spring copper which, when bent, can return to its original position. An example of a suitable copper includes 151 Cu or 155 Cu.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

What is claimed is:

1. A disconnect assembly for making and breaking an electrical connection to an electrical circuit, comprising:

a pullout assembly having a face portion composed of a non-electrically conductive material and at least two blade-receiving extensions extending away from the face portion and each of the blade-receiving extensions having a channel therethrough; and a removable conductive blade slidably received snugly within and through the at least two channels such that a first portion of the conductive blade is exposed for connection to a first lug-jaw connector and a second portion of the conductive blade is exposed for connection to a second lug-jaw connector, wherein the electrical connection to the electrical circuit is made or broken by urging the conductive blade into or out of the first and second lug-jaw connectors.

2. The assembly of claim 1, wherein the pullout assembly further includes a pullout handle connected to the face portion, whereby the handle is pulled to break the electrical connection to the electrical circuit.

3. The assembly of claim 2, wherein the electric circuit includes an air conditioning unit or is incorporated into a load center.

4. The assembly of claim 1, further comprising, a base assembly that includes the first and second lug-jaw connectors, each of the first and second lug-jaw connectors including a lug and a half jaw securely coupled to the lug, the half jaw including a curved clip portion that opposes a side surface of the lug, the portion of the conductive blade being received between the clip portion and the side surface, a bottom surface of the lug being mounted to a base of the base assembly.

5. The assembly of claim 4, wherein the lug includes a pocket that opens into the side surface, the pocket receiving a retaining portion of the half jaw that transitions into the clip portion.

6. The assembly of claim 4, wherein the lug includes a groove on the bottom surface that receives a retaining portion of the half jaw that transitions into the clip portion, the retaining portion of the half jaw being secured to the lug via an attachment means.

7. The assembly of claim 4, wherein the lug is composed of a material that includes aluminum.

8. The assembly of claim 4, wherein the conductive blade contacts the side surface of the lug when inserted between the lug and the clip portion.

9. The assembly of claim 1, wherein the conductive blade is composed of a material that includes copper.

10. The assembly of claim 9, wherein the half jaw is composed of a material that includes copper.

11. The assembly of claim 1, wherein the handle is molded integrally with the face portion and the non-electrically conductive material is plastic-based.

12. The assembly of claim 1, wherein the conductive blade is flat, has a rectangular shape, and is tapered at ends thereof.

13. The assembly of claim 1, wherein the assembly is incorporated into a switch or a circuit breaker.

14. The assembly of claim 13, wherein the pullout assembly is coupled to a mechanism that urges the blade into or out of the first and second lug-jaw connectors.

15. A disconnect assembly for making and breaking an electrical connection to an electrical circuit, comprising:

a pullout assembly that includes a blade-receiving extension having a channel therethrough;

a flat conductive blade that is slidably received within the channel such that at least two portions of the conductive blade are exposed for connection to respective lug-jaw connectors; and a base assembly that includes the lug jaw connectors, each of the lug-jaw connectors including a lug and a half jaw securely coupled to the lug, the half jaw including a clip portion that abuts against a side surface of the lug, one of the respective portions of the conductive blade being received between the clip portion and the side surface, a bottom surface of the lug being secured to a base of the base assembly, wherein the electrical connection to the electrical circuit is made or broken by urging the conductive blade into or out of the lug jaw connectors.

16. A disconnect assembly for making and breaking an electrical connection to an electrical circuit, comprising:

a pullout assembly having a face portion composed of a non-electrically conductive material and a blade-receiving extension extending away from the face portion and having a channel through the blade-receiving extension;

a conductive blade that is slidably received within the channel such that a portion of the conductive blade is exposed for connection to a lug-jaw connector; and a base assembly that includes the lug-jaw connector, the lug jaw connector including a lug and a half jaw securely coupled to the lug, the half jaw including a curved clip portion that opposes a side surface of the lug, the portion of the conductive blade being received between the clip portion and the side surface, a bottom surface of the lug being mounted to a base of the base assembly, wherein the electrical connection to the electrical circuit is made or broken by urging the conductive blade into or out of the lug-jaw connector.

* * * * *